United States Patent [19]

Rodriquez

[11] Patent Number: 4,870,876

[45] Date of Patent: Oct. 3, 1989

[54] PLIERS FOR INSERTING BUSHINGS

[76] Inventor: Ernesto Rodriquez, 221 East Ave. P-5, Palmdale, Calif. 93550

[21] Appl. No.: 256,269

[22] Filed: Oct. 11, 1988

Related U.S. Application Data

[63] Continuation of Ser. No. 97,700, Sep. 17, 1987, abandoned.

[51] Int. Cl.[4] ..... B25B 7/02

[52] U.S. Cl. ..... 81/426.5

[58] Field of Search ..... 81/426.5, 424.5, 418, 81/9.4, 9.42, 9.44; 248/56; 174/153 G, 65 G; 29/450, 235; 30/90.1, 90.2

[56] References Cited

U.S. PATENT DOCUMENTS

| | | | |
|---|---|---|---|
| 838,706 | 12/1906 | Fuller | 81/9.4 |
| 888,710 | 5/1908 | Janeway | 81/426 |
| 951,783 | 3/1910 | Laube | 81/420 |
| 1,176,604 | 3/1916 | Sanders | 81/426.5 |
| 1,216,886 | 2/1917 | Thomson | 81/420 |
| 1,388,898 | 8/1921 | Adams | 30/90.1 |
| 1,456,928 | 5/1923 | Lake | 81/9.4 |
| 1,623,689 | 4/1927 | Lind | 81/426.5 |
| 2,674,796 | 4/1954 | Herold | 30/90.1 |
| 2,967,303 | 1/1961 | Wise | 81/465.5 |
| 3,249,687 | 5/1966 | Klumpp, Jr. | 174/153 G |
| 3,464,659 | 9/1969 | Klumpp, Jr. | 174/153 G |
| 3,980,861 | 9/1976 | Fukunaga | 81/9.4 |

FOREIGN PATENT DOCUMENTS

| | | | |
|---|---|---|---|
| 0929358 | 6/1955 | Fed. Rep. of Germany | 81/426.5 |
| 257812 | 9/1926 | United Kingdom | 81/426.5 |

*Primary Examiner*—Robert P. Olszewski
*Assistant Examiner*—Blynn Shideler
*Attorney, Agent, or Firm*—Milton S. Gerstein

[57] ABSTRACT

Pliers for squeezing together the two parts of an electrical cord bushing for anchoring a cord portion. The pliers has a pair of power jaw elements, the gripping surface of which are formed with a plurality of differently-sized semicircular recesses, the two jaw surfaces cooperating to retain in oppositely-disposed recesses a busing for squeezing the two parts together. The pliers has a handle portion that is skew or offset from the power jaw elements to form an acute angle with the jaw elements so that the closed bushing may readily inserted into a hole of a chassis by the flush engagement of the rear surfaces of the jaw elements against the surface of the chassis in which is formed the hole for receiving the closed bushing.

2 Claims, 2 Drawing Sheets

FIG. 7
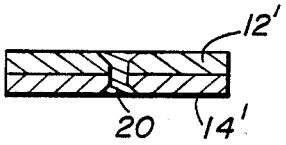
FIG. 8
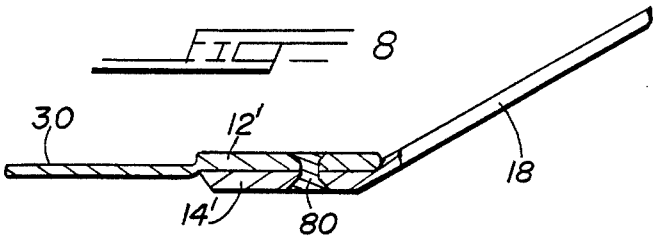
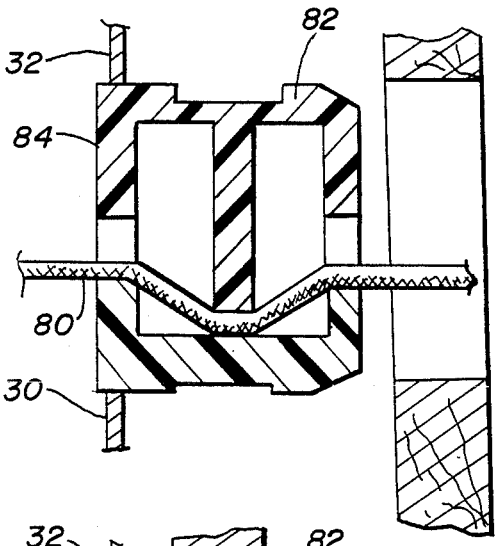
FIG. 9
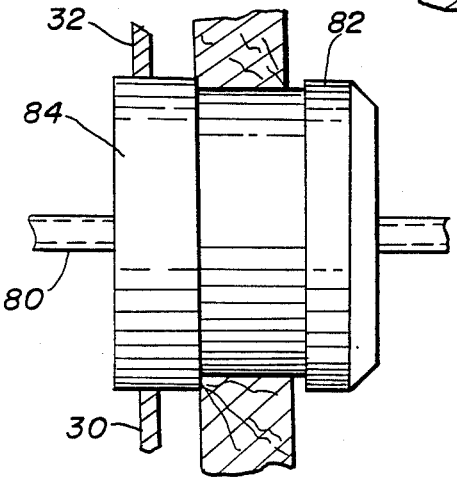
FIG. 10

PLIERS FOR INSERTING BUSHINGS

This is a continuation of co-pending application Ser. No. 097,700 filed on Sept. 17, 1987, now abandoned.

BACKGROUND OF THE INVENTION

The present invention is directed to pliers for holding and inserting electrical cord bushings into a chassis opening. Bushings for electrical cord or wire are used for holding or retaining the cord in place in a chassis, such as a chassis of a television, video recorder, personal computer, etc. The bushing, when closed, firmly grasps a portion of the cord and clasps the cord therein, so that, after the bushing is placed in an appropriately provided hole in a chassis, the bushing firmly anchors the cord in the chassis. Hithertofore, the emplacement of the bushing with cord therein into the hole of a chassis has been accomplished by a standard pliers which has proven to be difficult and time-consuming to use.

SUMMARY OF THE INVENTION

It is, therefore, the primary objective of the present invention to provide pliers especially suited for the effecting of a closed bushing for anchoring electrical cord therein by the squeezing together of the two parts of the bushing sandwiching therebetween the cord to be anchored in a chassis.

It is another objective of the invention to allow for the same pliers to be used to insert the closed bushing with anchored cord into a hole of chassis for fastening a portion of the cord to the chassis.

Toward these and other ends, the pliers of the invention includes a pair of jaw elements which grip therebetween the two pieces of the conventional bushing. Each jaw element has a gripping surface in which is cut out a plurality of differently-sized semicircular-shaped recesses for receiving half of the circular circumferential surface of the bushing, each jaw element's cutouts being juxtapositioned opposite the other jaw element's cutouts, so that together the jaw elements may firmly grasp, hold, and squeeze the bushing together to effect the firm anchoring of the cord portion positioned between the two parts of the bushing. In the preferred embodiment, each jaw element has three differently-sized semicircular-shaped recesses to accomodate the three different sizes of bushings prevalently used. The pliers is also skew or bent shape, with the handle portion preferably extending at an acute angle with respect to the jaw elements, so that after the cord portion is firmly gripped and anchored in the bushing, the pliers may then be used to insert the closed bushing into a chassis hole, the angular extension of the handle portion preventing the handle portion from interfering with such insertion and allowing for the jaw elements to be placed flush against the surface of the chassis in which surface is formed the hole or opening for receiving the closed bushing with cord portion anchored therein, to thus allow for easy emplacement of the closed bushing in the chassis opening.

BRIEF DESCRIPTION OF THE DRAWING

The invention will be more readily understood with reference to the accompanying drawing, wherein:

FIG. 7 is a cross-sectional view taken along line 7—7 of FIG. 1;

FIG. 8 is a cross-sectional view taken along line 8—8 of FIG. 1;

FIG. 9 is a cross-sectional view taken along line 9—9 of FIG. 1;

FIG. 10 is a detail view, in partial cross section, showing a closed cord bushing in one of the openings formed by the jaw elements of the pliers of the invention.

DETAILED DESCRIPTION OF THE INVENTION

Figure 1:
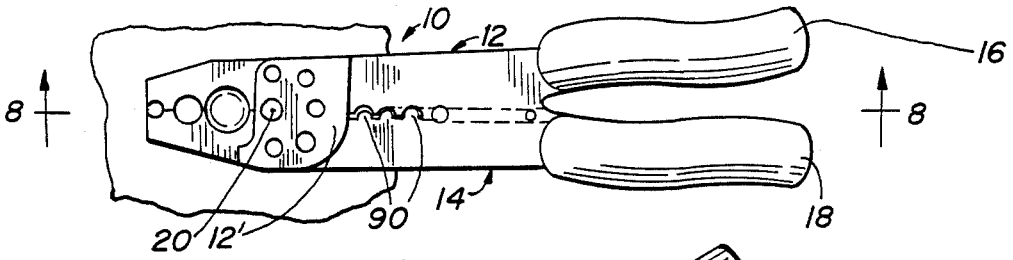
FIG. 1 is a plan view showing the pliers of the invention inserting a closed bushing with cord into a chassis hole.

Referring to the drawings in greater detail, the pliers of the invention is indicated generally by reference numeral 10. The pliers 10 has a pair of handle elements 12, 14 lying substantially in the same plane and coextensive with each other. Each handle element defines a central longitudinal axis thereof parallel to each other. The end of each handle element is provided with rubber gripping pads 16, 18 which are connected to extensions of the respective handle elements. The rubber gripping pads may lie along the same longitudinal axis of the respective handle element.

Figure 2:
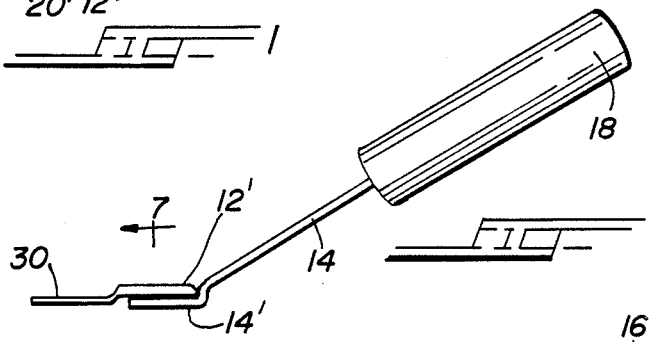
FIG. 2 is a a side elevation view of the pliers of the invention.
Figure 3:
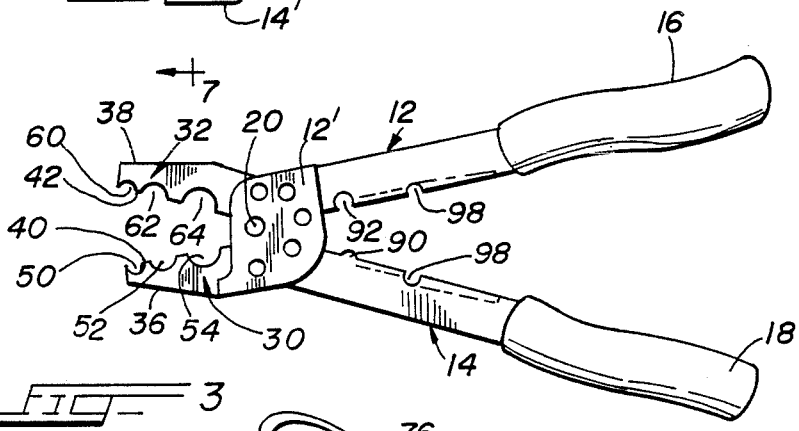
FIG. 3 is a top plan view of the pliers of the invention showing the pliers in its open position.
Figure 5:
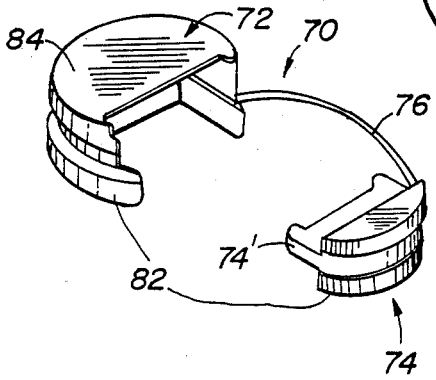
FIG. 5 is an isometric view of the bushing of FIG. 4.
Figure 6:
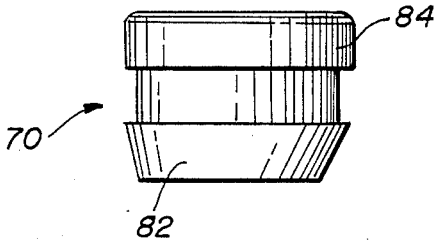
FIG. 6 is a side view thereof.

Each handle element has an angularly offset extension portion 12', 14' as seen in FIGS. 2 and 8. Each portion 12', 14' is substantially shaped as shown in FIGS. 1 and 3, and lie parallel to each other in parallel planes. The two portions 12' and 14' are pivotally connected by a pivot pin 20, that is countersunk at its two ends in the respective surfaces of the portions 12' and 14', as shown in FIG. 7. Each offset portion 12' and 14' lies in a plane that forms an acute angle with respect to the respective longitudinal axis of the respective handle element to which it is integrally connected. The preferred angle is 25°, and the preferred range being between 20° and 30°. Extending from each offset portion 12' and 14' is a power gripping jaw 30, 32, the jaw 30 being connected to the upper portion 12' so that it lies diametrically opposite the handle element 12 along the portion 12'. The power gripping jaw 32 extends from the lower portion 14' and lies diametrically opposite the handle element 14 along the portion 14'. Thus, when the handle elements 12 and 14 are squeezed toward each other, the power gripping jaws are also squeezed toward each other in the conventional manner. Each power gripping jaw has a rear surface 36, 38, respectively, and a front power surface face 40, 42. Formed in each front surface 40, 42 are a plurality of semicircular-shaped cutouts 50, 52, 54, and 60, 62, and 64, respectively. The cutouts 50 and 60, 52 and 62, and 54 and 64 cooperate respectively with each other, so that when the pliers is in its closed state, as shown FIG. 1, three circular cutouts or openings are formed, in each of which may be gripped and retained a specific size of bushing 70, shown in FIG. 5. The bushing 70 is comprised of two parts: The lower part 72 and the upper part 74, interconnected by a plastic connecting strip 76. The upper part 74 fits snugly into the lower part 72, which upper part 74 has a projecting retaining bead 74' which forces a portion of an electrical cord 80 downwardly against the bottom interior surface of the lower part 72, as shown in FIG. 9, to thereby sandwich between the edge of the bead 74' and the bottom surface of the lower part 72 the portion of the electrical cord.

Figure 4:
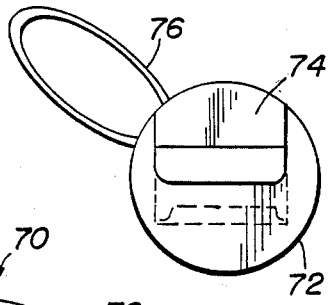
FIG. 4 is a top view of a standard cord bushing which is placed between the jaw elements of the pliers of the invention.

The size of the bushing 70, of course, varies depending upon the size of cord to be retained. The bushing 70 along with the retained cord portion are subsequently inserted into a hole formed in a chassis, in order to relieve stress and firmly hold the cord portion in place. As can be seen in FIG. 4, the bushing 70, when closed, has a circular cross section which fits into one of the openings formed by the cooperating cutouts of the power jaws. When the bushing is so positioned in a chosen opening, the handle elements may be squeezed to force the two parts 70 and 74 toward each other to forcibly squeeze these two parts together, with the cord portion therebetween. With the bushing 70 thus retained and held in the appropriate opening of the pliers, it may thereafter be easily inserted into a chassis opening by virtue of the fact that the handle elements 12, 14 are angularly offset from the portion 12' and 14' and from the jaws 30 and 32, which jaws 30, 32 are also coplanar and define a longitudinal axis forming an acute angle with respect to the longitudinal axis of the handle elements 12 and 14. Thus, the rear surface 36 or 38 of the jaws may be placed flush against the chassis surface, as shown in FIG. 1, with the handle elements 12, 14 projecting away from the very same surface so as to allow for a hand to grip the handle elements and provide ample space between the handle elements and the chassis surface in order to squeeze the handle elements together while inserting the closed and retained bushing into the chassis hole for secure anchoring via the enlarged annular end bead 82 which holds the stress-relief bushing or clamp in place in the chassis hole. The front enlarged annular bear 84, as shown in FIG. 9, is actually the part of the bushing that is preferably gripped by the power jaws when the bushing is placed in the appropriately-sized opening. The bead 82 provides a snap fit in the hole, a shown in FIG. 9.

In the preferred embodiment, the first circular opening formed by the cutouts 50, 60 has a radius of 3/16 in., the opening formed by the cutouts 52, 62 has a radius of curvature of ¼ in., and the opening formed by the cutouts 54, 64 has a radius of curvature of 7/32 in.

The inner surfaces of the handle elements are formed with crimping means defined by a plurality of projections 90 on the inner surface of one handle element, which are matingly received in recesses 92 formed in the inner surface of the other handle element. Outwardly toward the rubber gripping pads, there is provided a series of semicircular recesses 98 that together form small holes when the handle elements are squeezed toward each other. These holes that are formed are also of varying radii and are used for stripping splicing. A spring 97 may also be provided for urging the handle, and, therefore, the power gripping jaws, into their closed, contacting positions.

While a specific embodiment of the invention has been shown and described, it is to be understood that numerous changes and modifications may be made therein without departing from the scope, spirit, and intent of the invention as set forth in the appended claims.

What is claimed is:

1. Pliers in combination with a chassis-bushing comprising a first handle element and a second handle element, a first power jaw element and a second power jaw element, said power jaw elements being substantially coplanar for gripping and holding objects therebetween, each said power jaw element comprising a power-gripping surface, each said power-gripping surface comprising a plurality of semicircular-shaped cutouts, each cutout on each said surface having a radius of curvature different from another one of said plurality of cutouts, each said cutout being juxtapositioned oppositely a like cutout of the other said surface when said jaw elements are in their closed, mutually-contacting positions; one of said plurality of cutouts of each said surface having a radius of curvature of at least 0.25 inches, said one cutouts being juxtapositioned oppositely to each other;

each of said plurality of cutouts of each said surface comprising a completely unbroken, smooth surface by which an object may be gripped without damage to the object;

said first and second handle elements being angularly offset with respect to said first and second power jaw elements in order to space said handle elements from said first and second power jaw elements, so that proper clearance is provided for the hand gripping said handle elements during use;

a bushing for gripping and securing an electrical cord in a chassis hole, said bushing comprising a first main section defining a hollow interior in which is positioned a portion of an electrical cord to be secured, said first main section defining an open mouth portion, and an arcuate outer circumferential surface forming a portion of a cylinder, said outer surface having a first portion and a second anchoring portion for anchoring the bushing in a chassis hole; and a second securing section having an arcuate outer circumferential surface forming a portion of a cylinder having a first part thereof corresponding to said first portion of said first section, and a second anchoring part corresponding to said second anchoring portion of said first section; said second section also comprising a projecting retaining bead member for forced and tight insertion into said hollow interior of said first section through said open mouth thereof to retain a portion of an electrical cord in said hollow interior which portion of the cord is first positioned adjacent said open mouth, whereby said bead member forces said cord portion into said hollow interior during insertion and retains it therein due to the tight fit; said first portion of said first section and said first part of said second section defining together a circular gripping surface having a first annular portion which is positioned and retained in one of said plurality of cutouts of said first jaw element, and a second annular portion which is positioned and retained in one of said plurality of cutouts of said second jaw element juxtapositionally corresponding to said one cutout of said first jaw element; said first anchoring portion and said second anchoring part together defining a snap retainer for retaining the bushing in a chassis hole.

2. The improvement according to claim 1, wherein each said surface comprises three said cutouts, another said cutout having a radius of curvature of 7/32 inch, and a another said cutout having a radius of curvature of 3/16 inch.

* * * * *